United States Patent [19]

Eylers et al.

[11] Patent Number: 4,797,982

[45] Date of Patent: Jan. 17, 1989

[54] POCKET CLIP FOR WRITING INSTRUMENTS

[75] Inventors: Dieter Eylers; Hans Bamberger, both of Idar-Oberstein, Fed. Rep. of Germany

[73] Assignee: Gottlieb Roll GmbH & Co., Idar-Oberstein, Fed. Rep. of Germany

[21] Appl. No.: 131,190

[22] PCT Filed: Jan. 30, 1987

[86] PCT No.: PCT/EP87/00042

§ 371 Date: Aug. 6, 1987

§ 102(e) Date: Aug. 6, 1987

[87] PCT Pub. No.: WO87/04667

PCT Pub. Date: Aug. 13, 1987

[30] Foreign Application Priority Data

Feb. 7, 1986 [DE] Fed. Rep. of Germany ..... 3603876

[51] Int. Cl.[4] ..... B43K 25/00

[52] U.S. Cl. ..... 24/11 R; 24/11 CC; 24/11 M

[58] Field of Search ..... 24/11 R, 11 C, 11 CC, 24/11 CT, 11 S, 11 M, 11 HC, 15, 10 R, 10 A

[56] References Cited

U.S. PATENT DOCUMENTS

| | | | |
|---|---|---|---|
| 540,517 | 6/1895 | Russell | 24/10 R |
| 1,200,598 | 10/1916 | Roy | 24/11 R |
| 1,227,614 | 5/1917 | Hauptman | 24/10 R |
| 1,377,097 | 5/1921 | Seaton | 24/11 CT |
| 1,468,025 | 9/1923 | Klein . | |
| 1,477,551 | 12/1923 | Eva | 24/11 FE |
| 1,592,203 | 7/1926 | Hammalian | 24/11 CC |
| 1,999,966 | 4/1935 | Hernandez | 24/11 M |
| 2,579,080 | 12/1951 | Johnson . | |
| 3,051,130 | 8/1962 | Morris | 24/11 R |
| 3,576,053 | 4/1971 | Chiang | 24/11 M |

FOREIGN PATENT DOCUMENTS

| | | |
|---|---|---|
| 923580 | 7/1947 | France . |
| 947066 | 6/1949 | France . |

*Primary Examiner*—Victor N. Sakran

[57] ABSTRACT

Pocket clip for writing instruments, such as ball-point pens, fountain pen caps, turning or push-button automatic pencils and the like, having an elongated clip facing which is disposed on an elongated resilient tongue of a clasp made of spring-elastic strip material, which can be fastened to the writing instrument. The clip facing is a piece stamped from thin metal strip material and formed into a hollow body which is partially open on its back facing the writing instrument, and the elongated tongue is snapped into it.

6 Claims, 1 Drawing Sheet

Figures 1, 2, 3, 4, 5, 6:
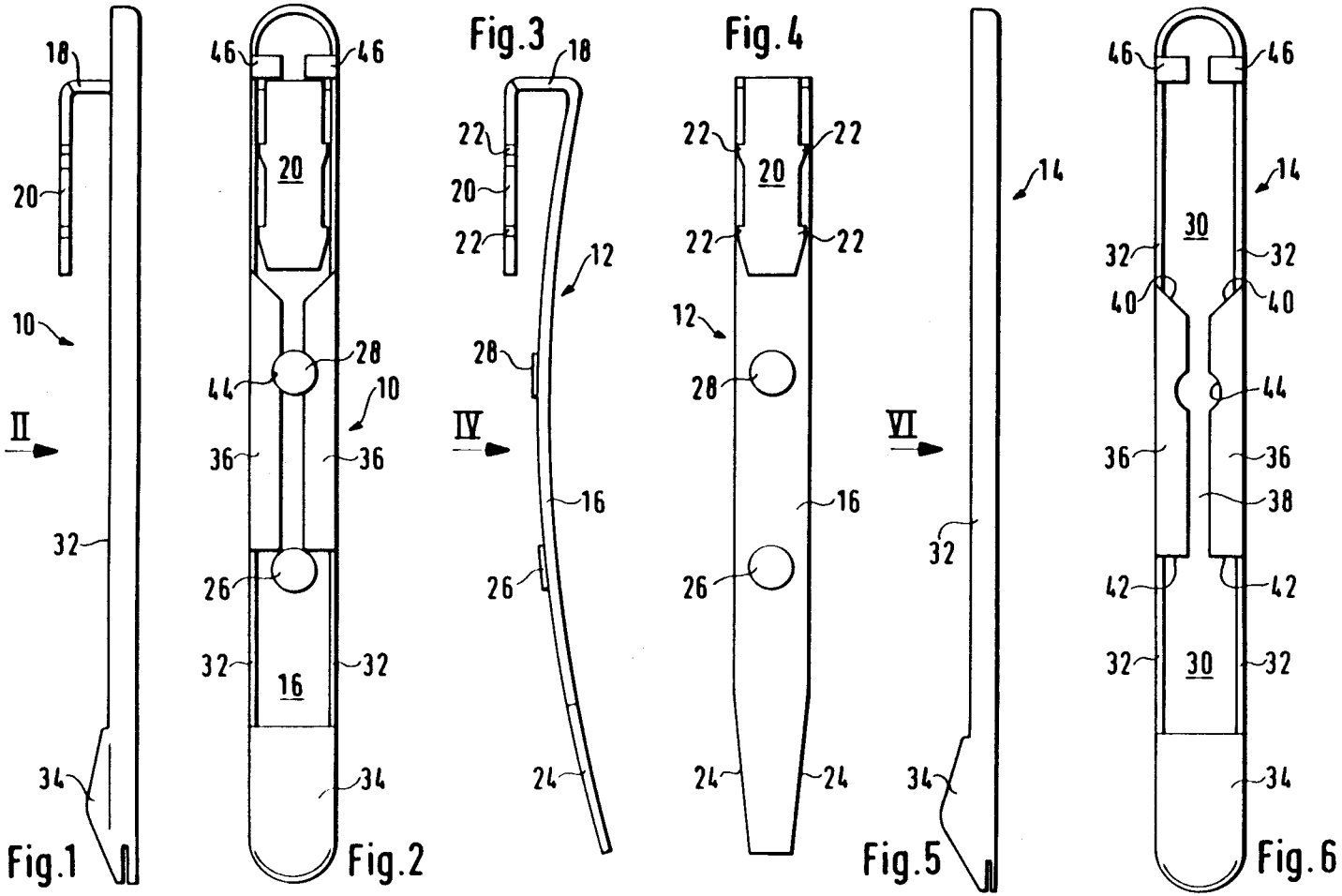

II
IV
VI

POCKET CLIP FOR WRITING INSTRUMENTS

The invention relates to a pocket clip for writing instruments, such as ball-point pens, fountain pen caps, push-button or turning automatic pencils and the like, having an elongated facing which is disposed on an elongated, resilient tongue of a clasp made of spring-elastic strip material. In such a pocket clip, the facing stamped from thin metal strip material has narrow marginal flanges formed on the lateral margins of its substantially planar elongated web area and bent backwardly toward the writing instrument, from each of which at least one holding bead extending over a portion of the length of the marginal flange is formed and bent toward the other holding bead, while the free space between the back of the web and the sides of the bead facing it is made approximately equal to or only slightly greater than the material thickness of the resilient tongue of the clasp and the width of the facing is made slightly less than the free width between the flanges of the facing so that the tongue can be inserted with its free end first into the space between the back of the web section and the flanges.

The clasps of pocket clips for writing instruments of the kind described above are fastened at their upper end to the writing instrument casing, while their bottom end, provided with an integral or separately attached clamping point is urged under bias against the writing instrument casing. When the writing instrument is inserted into the pocket of an article of clothing with resilient expansion of the free facing end such that the actual writing instrument lies substantially inside of the pocket but the facing lies on the outside of the pocket, the writing instrument is secured against accidentally falling out of the pocket by the clasp gripping the material of the pocket between the writing instrument casing and the deflected clamping point, while at the same time deliberate removal is possible.

In addition to the integral manufacture of the entire pocket clip from spring-elastic metal strip material, pocket clips of the kind described above are known (FR-A No. 923 580) in which the pocket clip and its clasp are made separately and then joined together. This makes it possible to manufacture the visible part, or facing, in a form and from a material chosen only for its attractive appearance, while the bias of the clip, which is essential to the gripping function, is obtained by making the clasp, which in the assembled state is not visible, from a spring-elastic metal strip material. The joining of the facing to the tongue of the clasp has been performed heretofore by riveting or crimping the parts; in other words, a permanent deformation of the rivets or of sections of the material of one or both of the parts to be joined together serves to produce a positive fastening.

The invention is addressed to the problem of creating a two-piece pocket clip composed of a clasp and a separately made facing, in which the two parts are joined together more simply and quickly, and especially without permanent material deformation.

Setting out from a pocket clip of the kind described above, this problem is solved according to the invention by the fact that the facing has in the area of its upper end that is to be fastened to the writing instrument two tabs formed on the marginal flanges and bent to a position in which their free ends are pointing toward one another. When the tongue is inserted, the tongue is first guided with resilient deformation past the tabs and under the beads. Then, as soon as the tongue has been pushed into the proper fastening position, it snaps behind the tabs into engagement with the surface of the web of the facing. The tabs thus secure the tongue against withdrawal from the facing.

In an advantageous further development of the invention an additional fastening of the facing and tongue can be achieved by making the width of the bead such that a narrow, slot-like interstice remains between its free edges, and the tongue has at least one projection which, in the proper fastening position, protrudes above the bead immediately behind the end of the bead opposite the insertion end, and whose diameter is greater than the width of the slot-like interstice between the beads. When the tongue is inserted into the interstice between the web area and the bead, the projection forces the beads slightly apart When the proper fastening position is reached, the beads, however, then snap back behind the projection and secure the tongue, in addition to the tabs, against withdrawal.

To facilitate pushing the tongue through the interstice between the beads it is recommendable to chamfer the beads at their terminal edges situated forwardly in the direction of insertion, from the flanges toward the gap-like interstice in the direction of insertion. The projection comes in contact with the chamfered edges during insertion and then expands the beads by wedging action such that the force required for the insertion of the tongue is substantially reduced in comparison to the unchamfered edges at the opposite end.

In order to make the joint tight between the facing and the tongue in spite of the tolerances which the parts require for the assembly operation, the tongue can be slightly convexly curved with respect to the inner side of the facing. When in the proper fastening position, the originally curved clasp tongue is then deformed to a planar position, but seeks to spring back to the curved shape. At the same time the tongue is tensed between the web area and the beads, so that any free play that might be present is compensated.

In the forward terminal part of the tongue its width is desirably reduced towards its free end, in order to facilitate the insertion of its free end under the beads.

In an advantageous further development of the invention the tongue can have in the area which, in the proper fastening position, is underneath the slot-like interstice, an additional projection protruding toward the beads and having a diameter that is greater than the width of the interstice between the beads, in which case the slot-like interstice is widened in the area associated with the projection to correspond to the size of the projection. This second projection thus constitutes an additional security against withdrawing the tongue, but also against pushing it too far in.

The invention is further explained in the following description of an embodiment, in conjunction with the drawing, wherein:

FIG. 1 is a side elevational view of a pocket clip configured in the manner according to the invention, FIG. 2 is a view of the pocket clip as seen in the direction of the arrow 2 in FIG. 1, FIG. 3 is a side view of the clasp of the pocket clip shown in FIGS. 1 and 2, FIG. 4 is a view of the clasp, seen in the direction of the arrow 4 in FIG. 3, FIG. 5 is a side view of the facing of the pocket clip shown in FIGS. 1 and 2, and FIG. 6 is a view of the facing, seen in the direction of the arrow 6 in FIG. 5.

The pocket clip according to the invention, shown in FIGS. 1 and 2 and identified as a whole by the number 10, is composed of two parts, namely the clasp 12 represented in FIGS. 3 and 4 and the facing 14 shown in FIGS. 5 and 6.

The clasp 12 has an elongated resilient tongue 16 cut from spring-elastic, metal strip material, which is curved over its length in the manner which can be seen in FIG. 3. At the upper end of the tongue 16 there is integrally formed a short transition 18 bent away at approximately right angles, from whose other end a slightly longer fastening tab is bent downwardly, i.e., in the same direction as the tongue 16, but is considerably shorter than the tongue 16. This fastening tab 20 is intended for fastening in an opening or recess of corresponding narrow dimensions in the casing of a writing instrument, e.g., a ball-point pen, and for security against unintentional release from this housing it has barb-like teeth 22 created on the lateral margins, which, on account of their shape gradually tapering forwardly, i.e., toward the free end of the fastening tab 20, offer but slight resistance to insertion into the above-mentioned opening or recess, but when an attempt is made to withdraw the fastening tab 20 out of the recess they embed their sharp points at their rearward end into the material of the casing. Fastening tabs of this configuration are known in themselves, and are shown and described here only to indicate one possible manner of fastening, without excluding alternative modes of fastening to the casings of writing instruments. For example, an annular sleeve lying in the plane of the transition 18 could adjoin the transition 18, and could be screwed between the finial and the thimble-like cap in the manner commonly practiced in fountain pen caps.

In the terminal area opposite the transition 18 the tongue 16 tapers in plan towards its free end at the lateral edges 24 which slope in this area. This taper facilitates installation in the facing 14 which will be described below.

At a distance apart lengthwise along the longitudinal center line of the tongue 16 two low projections 26 and 28 circularly defined in plan are formed in the middle portion of the tongue 16 from the material thereof, on the side thereof facing the fastening tab 20, and they cooperate with parts of the facing 14 as locking projections, in the manner to be described hereinbelow.

The facing represented in FIGS. 5 and 6 is a part made by stamping from thin sheet metal, which has an elongated planar web area 30, which in the illustrated case is semicircularly rounded at the top and bottom end, and which is adjoined at its lateral longitudinal margins by marginal flanges 32 of relatively low height bent at right angles. These marginal flanges 32 joined at the upper semicircular end of the of the web area 30 stiffen the web area 30 against flexure and give the impression, when one looks at the outer surface of the web area 30, that the facing 14 is a relative massive piece of metal, although material and weight are saved in comparison with such a [massive] piece of metal.

In the lower end part of the facing, a clip point 34 is formed in a suitable manner from the material of the facing itself, but its precise configuration and manufacture need not be further described in the present connection, because it is not essential to the invention.

In the middle area of the facing 14, at each of the free margins of the flanges 32, a narrow holding bead 36 is formed and bent at approximately right angles toward the other holding bead 36, leaving a slot-like interstice 38 between the free edges of the holding beads 36 bent away from the flanges. The forward or upper terminal edges 40 of the holding bead 36 are made to slant downwardly from the flanges 32, while the terminal edges provided at the other, rearward end run at right angles to the lateral margins of the facing.

The interstice 38 is expanded at 44 such that, upon assembly later on, the projection 28 of the tongue 16 will be fitted into this widened area 44. On the other hand, the length of the holding beads 36 at the bottom end is such that the projection 26 will be just under the terminal edges 42 of the holding bead 36 when the projection 28 is situated in the above-mentioned area 44 (FIG. 2).

In the upper end area of the facing 14, a tab 46 is formed on each flange 32 and bent at right angles toward the opposite tab. The transition 18 of the clasp 12 abuts against these tabs 46 after the clasp is installed on the facing 14 (see FIG. 2).

The clasp 12 is installed such that the tapering front end of the tongue 16 is inserted from above into the interstice between the back of the web area 30 and the holding bead 36 of the facing 14 and forced downwardly. The curved tongue 16 then deforms when inserted under the holding bead 36 such that it can be pushed through the interstice between the back of the web area 30 and the holding bead 36. As soon as the projections 26 and 28 reach the catch position associated with them, the tongue 16 springs slightly back, so that the projection 26 then will be in front of the bottom terminal edge 42 and the projection 28 will emerge in the expanded area 44 thereby locking the tongue 16 against withdrawal. Upon its insertion under the holding bead 36, the tongue 16 has been deformed from the curved shape shown in FIG. 3 to a planar position parallel to the flange 30, but, due to its effort to flex back again, it exerts a tension on the web area 30 and the holding beads 36, so that a clearance-free holding of the tongue 16 in the facing 14 is achieved. In addition to the locking of the projections 26 and 28 at the terminal edges 42 and in the widened area 44, the transition 18 bent away from the upper end of the tongue 16 is also locked against the bent tabs 46.

It is apparent that by the above-described joining of the clasp 12 to the facing 14 the latter are so tightly joined together even without additional riveting that they are not separable from one another without the application of considerable force.

We claim:

1. A pocket clip for a writing instrument, such as a ball-point pen, fountain pen cap, or the like, comprising: a clasp of spring-elastic strip material having a resilient tongue with a free end; an elongated facing disposed on said tongue, and stamped from thin metal material, said facing having a substantially planar elongated web and two low marginal flanges respectively formed on lateral margins of said web and extending away therefrom; at least one holding bead extending from each of said marginal flanges over a portion of the length of the respective marginal flange and bent toward the other holding bead; there being a free space between the web and the beads, said free space being approximately equal to or only slightly greater than the thickness of the resilient tongue and the width of the facing being slightly less than the free width between the marginal flanges, so that the free end of the tongue is insertable into the space between the web and the flanges; the facing having an upper end to be fastened to the writing instrument, and two tabs at said upper end, formed on the flanges and having free ends bent to a position in which they point toward one another, said tabs having bottom transverse edges and being so disposed that in a fastening position of the clip the resilient tongue in locked against withdrawal from said facing by said edges; the width of the beads being such that a narrow, slot-like interstice remains therebetween, the tongue having at least one first projection which, in the fastening position, protrudes above and directly behind the bead opposite the end of insertion of the tongue, said first projection having a diameter greater than the width of the slot-like interstice.

2. A pocket clip according to claim 1, wherein terminal edges of said beads adjacent said tabs are chamfered in the direction of insertion from the flanges toward the slot-like interstice.

3. A pocket clip according to claim 1, wherein the tongue is slightly convexly curved with respect to the web of the facing.

4. A pocket clip according to claim 2, wherein the tongue is slightly convexly curved with respect to the web of the facing.

5. A pocket clip according to any one of claims 8 to 11, wherein the tongue has a second projection protruding toward the beads in an area which, in the fastening position, lies under the slot-like interstice, said second projection having a diameter greater than the width of the interstice between the beads, the slot-like interstice being widened in an area associated with the second projection in accordance with the size of the second projection.

6. A pocket clip according to claim 5, wherein the width of the tongue decreases towards its free end.

* * * * *